US005735707A

United States Patent [19]

O'Groske et al.

[11] Patent Number: 5,735,707

[45] Date of Patent: Apr. 7, 1998

[54] MULTI-DIRECTIONAL SHIELDED CABLE EXIT

[75] Inventors: Rolland Dean O'Groske; Glenn Ray Oldenburg; Sandra Jeanne Shirk/Heath; Keith Franklin Tharp; Scott Marvin Thorvilson; Randall Vincent Tointon, all of Rochester, Minn.

[73] Assignee: International Business Machines Corporation, Armonk, N.Y.

[21] Appl. No.: 644,682

[22] Filed: May 30, 1996

[51] Int. Cl.[6] ..... H01R 13/56

[52] U.S. Cl. ..... 439/446; 439/610

[58] Field of Search ..... 439/446, 610, 439/6, 8, 9

[56] References Cited

U.S. PATENT DOCUMENTS

| | | | |
|---|---|---|---|
| 4,111,513 | 9/1978 | Thurston et al. | 439/610 |
| 4,433,206 | 2/1984 | Lewis | 174/356 |
| 4,447,100 | 5/1984 | Dyce et al. | 29/862 |
| 4,619,494 | 10/1986 | Noorily et al. . | |
| 4,629,276 | 12/1986 | Genaro et al. . | |
| 4,653,825 | 3/1987 | Olsson | 29/861 |
| 4,682,836 | 7/1987 | Noorily et al. | 439/426 |
| 4,711,507 | 12/1987 | Noorily | 439/292 |
| 4,902,249 | 2/1990 | Morishita et al. | 439/610 |
| 4,921,449 | 5/1990 | Fish | 439/610 |
| 5,052,947 | 10/1991 | Brodie et al. | 439/607 |
| 5,372,520 | 12/1994 | Kilbey et al. | 439/466 |
| 5,380,219 | 1/1995 | Klier | 439/446 |
| 5,389,006 | 2/1995 | Norschese | 439/465 |

FOREIGN PATENT DOCUMENTS

| | | | |
|---|---|---|---|
| 959196 | 9/1982 | U.S.S.R. | 439/446 |
| 2085242 | 4/1982 | United Kingdom | 439/446 |

*Primary Examiner*—Gary F. Paumen

*Attorney, Agent, or Firm*—Merchant, Gould, Smith, Edell, Welter & Schmidt

[57] ABSTRACT

An electrical connector having a housing and a swivel member. The housing defines an opening and the swivel member defines a cable passageway. The swivel member is configured so that an electrical cable may be disposed through the cable passageway and the opening. The swivel member is pivotally mounted to the housing such that, when an electrical cable is disposed in the passageway, the cable may pivotally move with respect to the housing.

16 Claims, 5 Drawing Sheets

FIGURE 2 Section 2-2

FIGURE 3 Section 1-1

MULTI-DIRECTIONAL SHIELDED CABLE EXIT

FIELD OF THE INVENTION

The present invention relates generally to electrical connectors and, more particularly, to electrical connectors having multi-directional shielded cable exits.

BACKGROUND OF THE INVENTION

Electrical connectors are used in the electronic industry to provide an interface between a signal carrying cable and a receptacle or a plug which may be the termination of another cable, such as a telecommunications cable, or which may be a receptacle or a plug on an electronic device, such as a computer, a printer, etc. The signal carrying cable typically includes a plurality of wires surrounded by a cable jacket. Preferably disposed between the wires and the cable jacket is a braid shield, which is grounded to provide electromagnetic shielding of the cable wires. The electrical devices to which the cables are interfaced are often used in tight spaces and/or interconnected with a number of other devices. Accordingly, many cables run between devices in tight spaces, and routing of these cables becomes a critical design factor.

In electrical connectors known in the prior art the cable typically extends straight back from the electrical connector. Since the cable is most often semi-rigid and of a thick density (e.g. ⅜ inches and above in diameter), little cable bend is afforded in the area immediately behind the connector. Thus, the cables of these connectors either cannot be appropriately routed, or when routed, considerable cable strain results from trying to bend the cable in tight spaces.

Attempts have been made to ease cable routing and reduce cable strain by providing electrical connectors with multiple cable exits. See, for example, U.S. Pat. No. 4,629,276. Though these connectors provide for multiple cable exit directions, each cable exit direction is fixed or static. That is, once the connector is assembled, the cable exit direction cannot be changed unless the connector is disassembled. The need to disassemble the connector to change the cable exit direction is awkward and time-consuming. Moreover, the number of multiple cable exit directions is limited. Thus, in tight spaces, even these electrical connectors are not capable of effectively routing the cable. For example, limited cable exit directions may limit access to cable retention features.

Consequently, there exists in the electronic industry, a need for an electrical connector having a dynamic multi-directional cable exit for enabling efficient routing of electrical cables. There exists a further need to provide electromagnetic shielding of the cable wires in such an electrical connector. The present invention addresses these and other needs.

SUMMARY OF THE INVENTION

The present invention is an electrical connector having a housing and a swivel member. The housing defines an opening and the swivel member defines a cable passageway. The swivel member is configured so that an electrical cable may be disposed through the cable passageway and the opening. The swivel member is pivotally mounted to the housing such that, when an electrical cable is disposed in the passageway, the cable may pivotally move with respect to the housing.

DETAILED DESCRIPTION OF THE EMBODIMENTS

Figure 1:
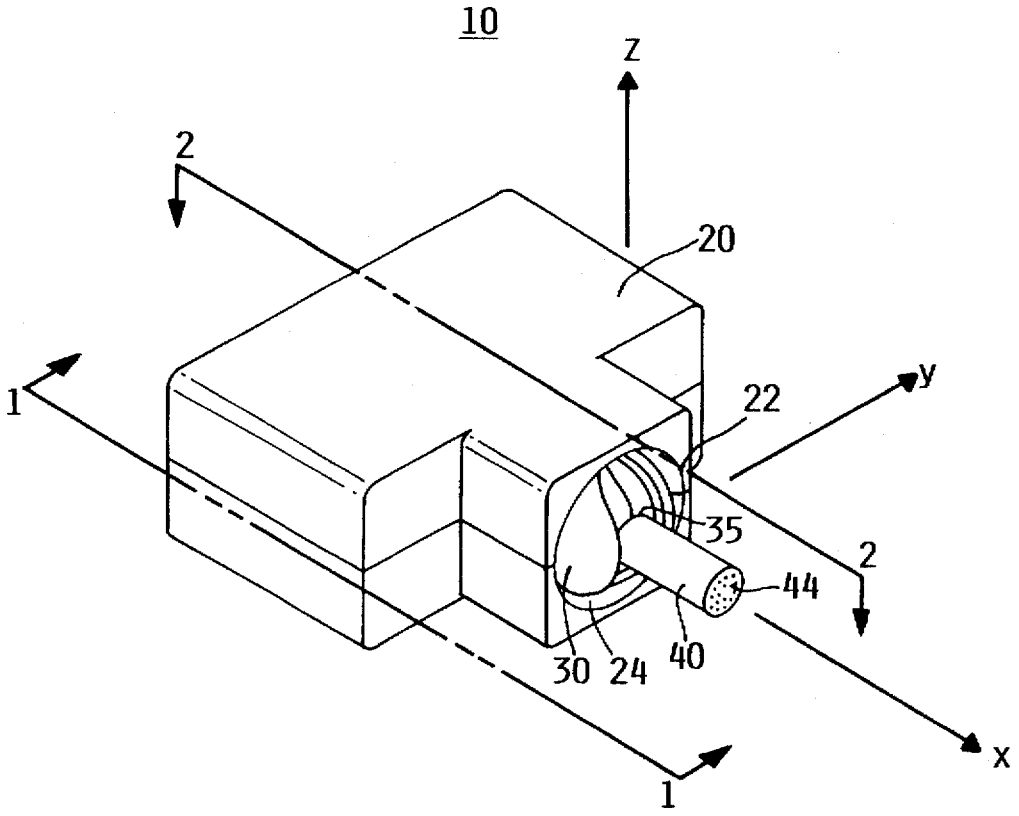
FIG. 1 is a perspective view of an exemplary embodiment of an electrical connector.
Figure 4:
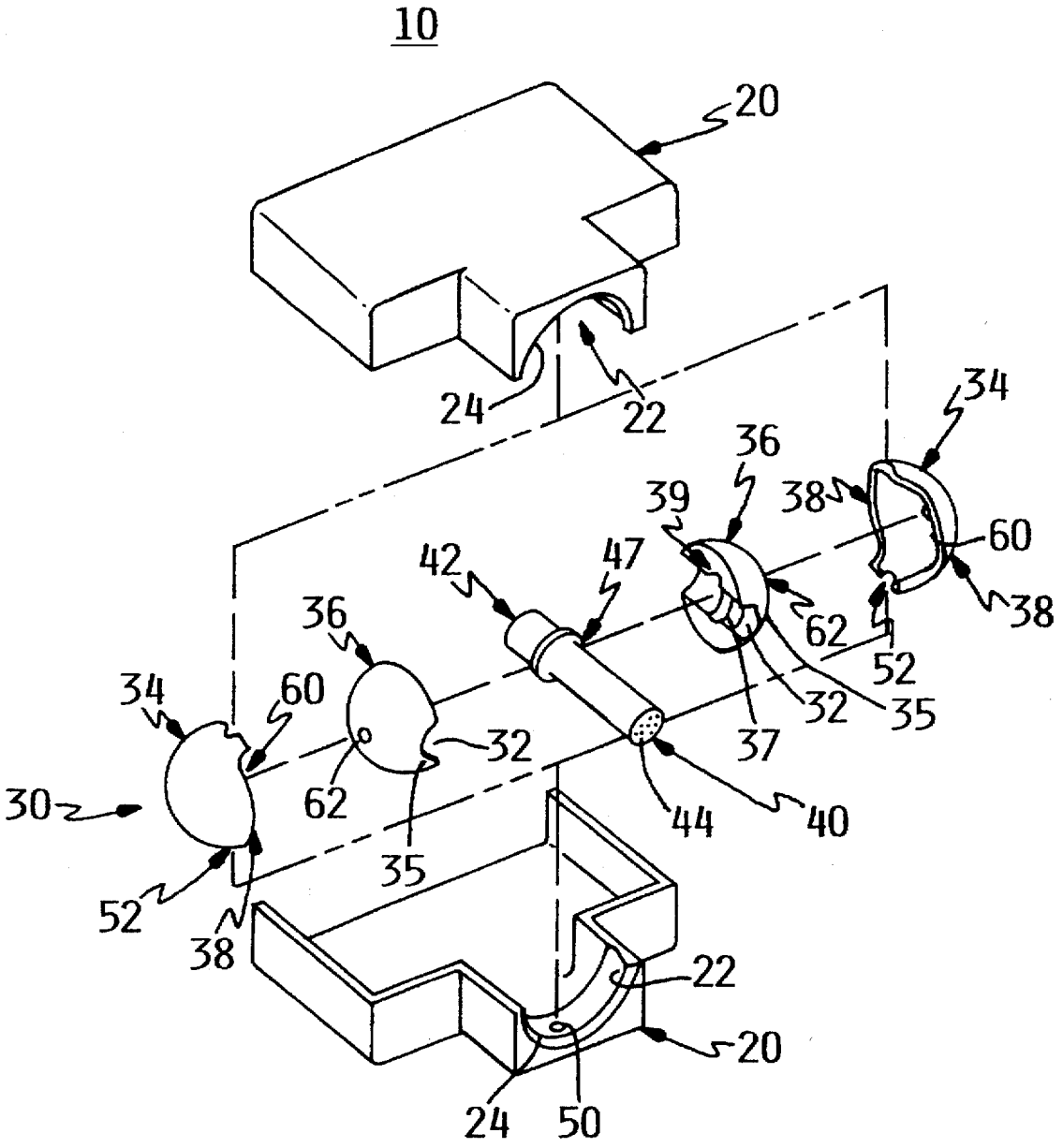
FIG. 4 is a partial, exploded perspective view of the electrical connector shown in FIG. 1.

Referring now to the drawings, and more particularly to FIGS. 1 and 4, there is shown an exemplary electrical connector 10 for interfacing an electrical cable 40 with a mating connector on an electrical device such as a computer. Electrical connector 10 includes a housing 20 and a swivel member 30 pivotally mounted within housing 20. Housing 20 may comprise two symmetrical body portions forming an interior chamber, as shown in FIG. 4, and may be constructed of a metal or plastic. In the exemplary embodiment, housing 20 comprises a zinc diecast metal shell. Though not shown, the metal shell may be enclosed in a plastic outer housing made of a polyvinylchloride (PVC) plastic or a similar material.

The front of electrical connector 10 typically includes a plurality of contacts which plug into the mating connector. At the rear end of electrical connector 10, housing 20 defines an opening 22 that houses swivel member 30 and from which cable 40 may exit in an unlimited number of directions as will be explained more fully hereinafter. Opening 22 may be circular with a diameter greater than the diameter of electrical cable 40.

Figure 2:
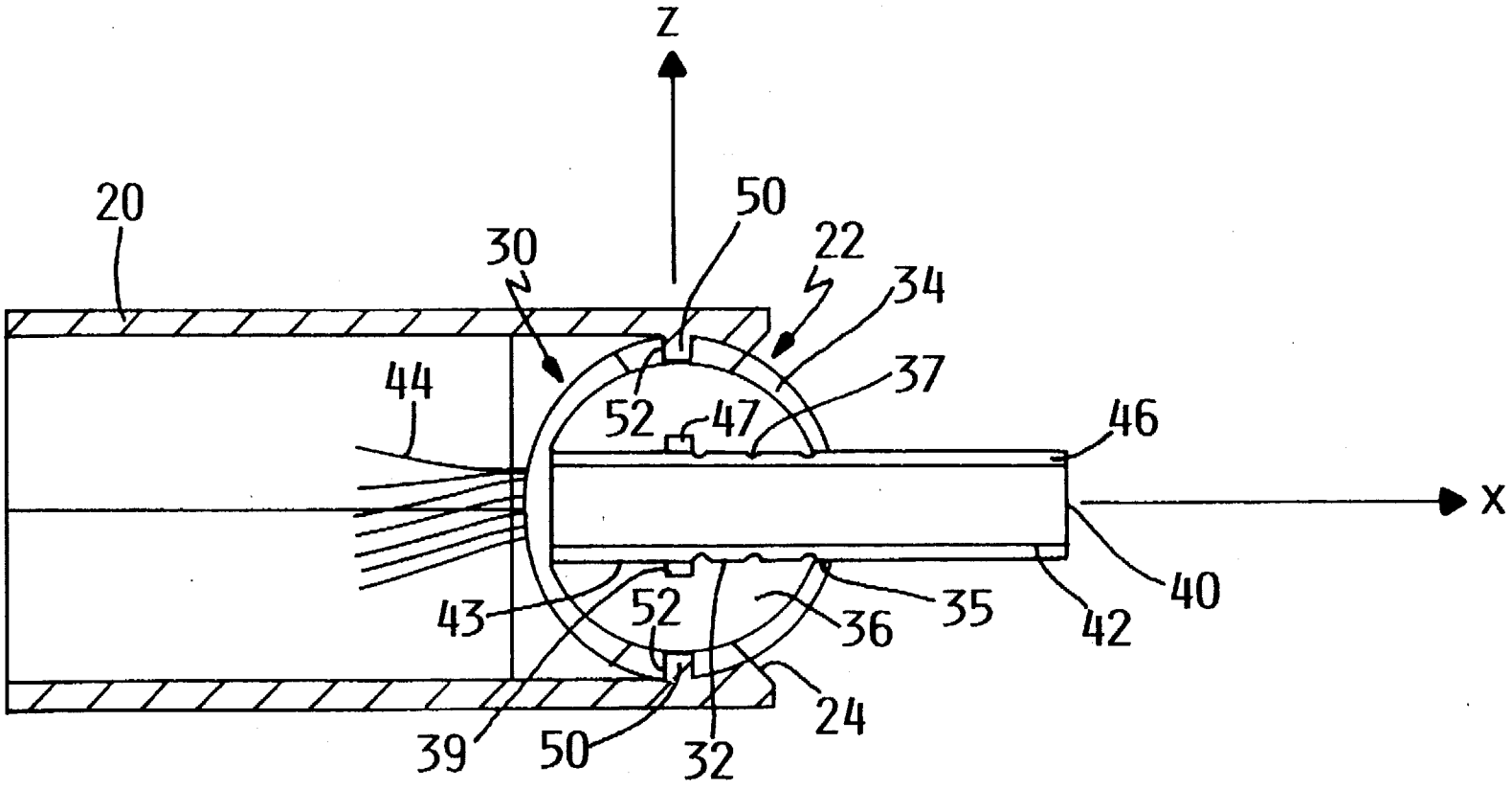
FIG. 2 is a cross-sectional view along the line B—B of the electrical connector shown in FIG. 1.
Figure 3:
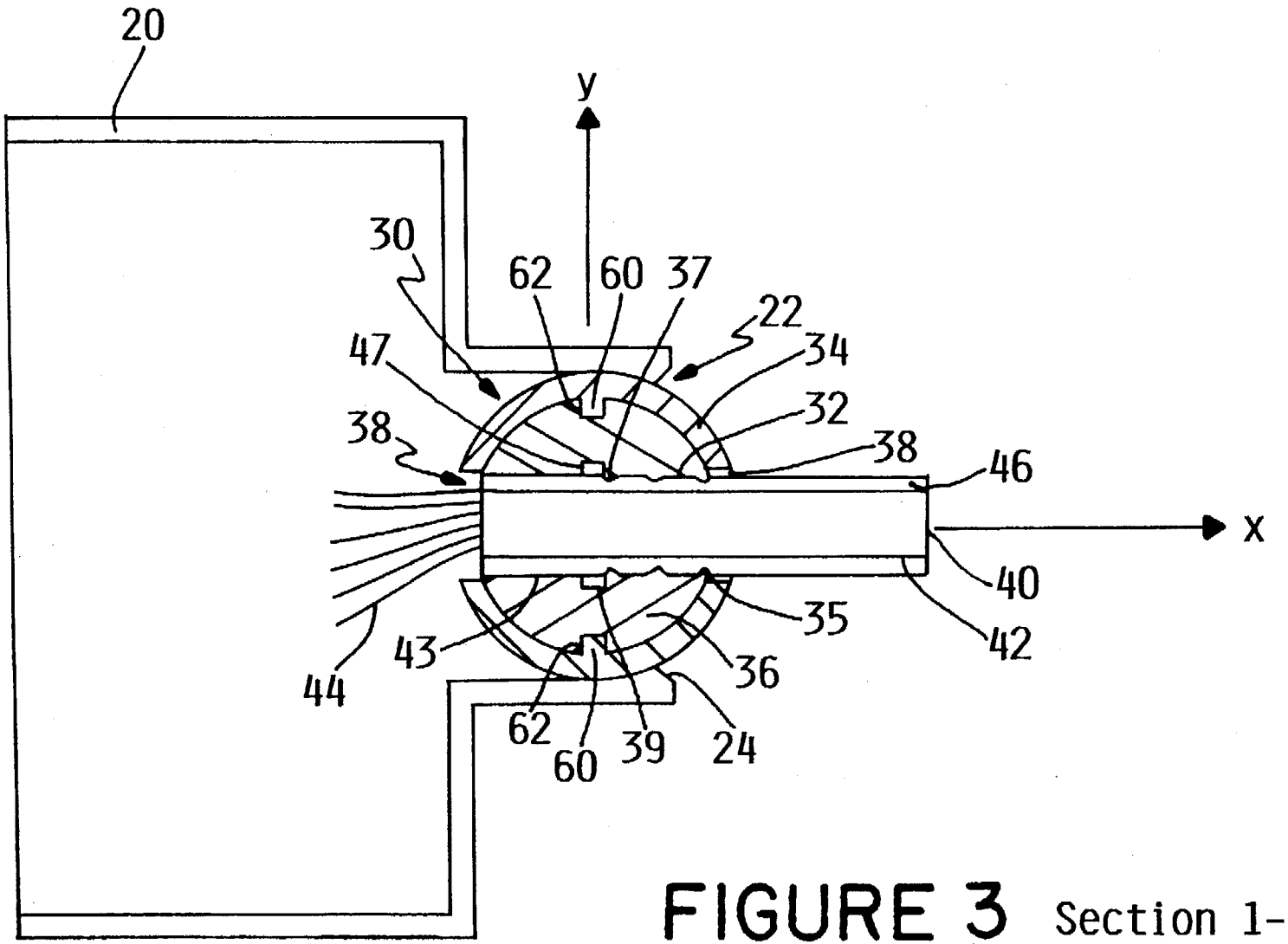
FIG. 3 is a cross-sectional view along the line A—A of the electrical connector shown in FIG. 1.

As best shown in FIGS. 2–4, swivel member 30 of the exemplary embodiment comprises an outer spherical shell 34 disposed about an inner spherical member 36. Inner spherical member 36 defines a cable passageway 32 therethrough for receiving cable 40. At the end of passageway 32, there is defined a cable exit 35, as best shown in FIG. 3. Provided about the perimeter of the passageway 32 are a series of circumferential ridges 37 for securely retaining cable 40 within inner spherical member 36 and a circumferential groove 39 for purposes to become apparent hereinafter. Outer spherical shell 34 defines a pair of oppositely faced slots 38 having a width greater than the diameter of cable 40 and which may align with cable exit 35 such that cable 40 may pass through outer spherical shell 34. Slots 38 also allow cable 40 to rotate with respect to outer spherical shell 34 as will be shown hereinafter.

Figure 5:
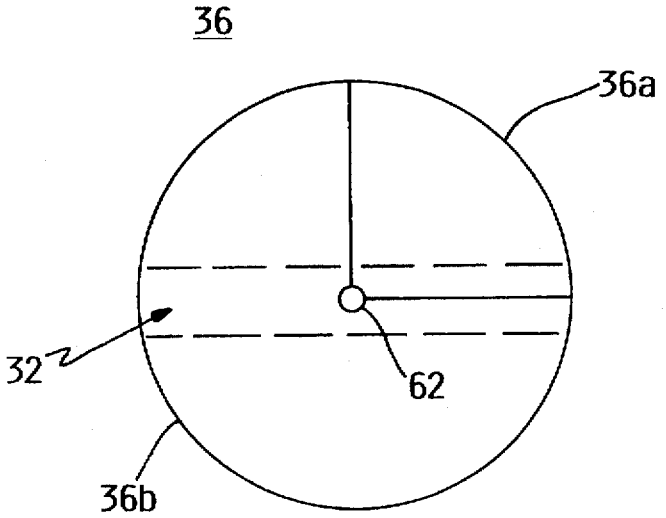
FIG. 5 is an alternate embodiment of an inner spherical member.

As illustrated in FIG. 4, outer spherical shell 34 and inner spherical member 36 may each comprise two spherical members which may be assembled, for example, by riveting, recessed screws, bonding or other means, to form outer spherical shell 34 and inner spherical member 36. In the exemplary embodiment, the spherical members are symmetrical as best shown in FIG. 4. In alternate embodiments, the spherical members may be nonsymmetrical. For instance, inner spherical member 36 may comprise one spherical member **36*b* forming substantially ¾ of inner spherical member 36 and a second spherical member 36*a* forming ¼ of inner spherical member 36, as shown in FIG. 5. Both outer spherical shell 34 and inner spherical member 36** may be made of a conductive material, such as a zinc metal diecast.

As best illustrated with reference to FIGS. 2–4, swivel member 30 is pivotally mounted at the rear end of housing 20 such that cable exit 35 is aligned with and pivots within opening 22. For pivotally mounting swivel member 30 within housing 20, housing 20 includes a pair of linearly-aligned pivots 50 extending into its interior chamber along a line passing through the center of swivel member 30. Outer pivots 50 are received by a pair of holes 52 disposed in the outer surface of outer spherical shell 34. For pivotally mounting inner spherical member 36 within outer spherical shell 34, outer spherical shell 34 includes a second pair of linearly aligned pivots 60 extending radially inward from its inner surface. Inner pivots 60 are received by a second pair of holes 62 disposed in the outer surface of inner spherical member 36. As best shown in FIG. 4, outer and inner pivots 50 and 60 and corresponding holes 52 and 62 may be cylindrically shaped with circular cross sections.

In the exemplary embodiment, outer pivots 50 are vertically disposed relative to housing 20 and thus allow outer spherical shell 34 to pivot side-to-side. Inner pivots 60 are horizontally disposed relative to housing 20 and thus allow inner spherical member 36 to pivot up and down with respect to outer spherical shell 34. Accordingly, cable 40 may rotate to face in any direction. However, outer pivots 50 and inner pivots 60 prevent cable 40 from rotating about its longitudinal axis. Thus, twisting of cable wires 44 is prevented. It should be appreciated that the illustrated orientation of electrical connector 10 is exemplary only.

The pivoting of the swivel member 30 within housing 20 may be more fully understood with reference to the x-y-z axes of cable 40 as illustrated in FIGS. 1–3. As cable 40 is rotated about its y-axis outer spherical shell 34 remains fixed due to pivots 50, inner spherical member 36 rotates with respect to housing 20, and cable 40 slides within slots 38 of outer spherical shell 34. As cable 40 is rotated about its z-axis, inner spherical member 36 remains fixed with respect to outer spherical shell 34 due to pivots 60; however, both outer spherical shell 34 and inner spherical member 36 pivot with respect to housing 20.

The maximum angle from which cable 40 may exit electrical connector 10 is defined by an edge 24 of opening 22, as best shown in FIGS. 2 and 3. For example, in the exemplary embodiment, approximately one quarter of swivel member 30 extends beyond edge 24, thus the maximum exit angle is approximately 45°. In alternate embodiments, the amount by which swivel member 30 extends beyond edge 24 may be greater or less than that illustrated. For example, for an exit angle on the order of 90°, the swivel member 30 is mounted such that approximately one half of it extends beyond edge 24. Furthermore, as shown best in FIGS. 2 and 3, edge 24 of opening 22 may be chamfered so as to provide strain relief for and prevent shearing of electrical cable 40.

It is noted that the scope of the invention is not limited by the position and number of pivots in the exemplary embodiment nor by the structure of swivel member 30. For example, in an alternate embodiment, the pivot and hole arrangements may be reversed such that the housing has a pair of holes and the outer spherical shell has an outer pair of pivots and/or the inner spherical member has a pair of pivots and the outer spherical shell has an inner pair of holes. In further embodiments, each pair of pivots 50, 60 may be replaced by one pivot. In further alternate embodiments, pivots 50, 60 may not be perpendicular to one another, provided that, if two axes of rotation are desired, outer pivots 50 and inner pivots 60 are not parallelly disposed. Moreover, pivots 50, 60 may lie in different planes and on lines not extending through the center of the spherical member, provided housing 20 and/or outer shell 34 are appropriately structured. In addition, if cable rotation about only one axis is desired, swivel member 30 may comprise one spherical member associated with one set of pivots.

In further alternate embodiments, swivel member 30, rather than being comprised of a outer spherical shell and an inner spherical member, may comprise only one spherical member having a groove disposed about its outer surface for receiving pivots 50 of housing 20. The groove may run substantially parallel with the longitudinal axis of the cable passageway 32 such that the cable 40 will not rotate about its longitudinal axis. In further alternate embodiments, swivel member 30 may be nonspherical provided housing 20 is appropriately structured.

In addition to providing a multi-directional cable exit 35, electrical connector 10 provides a ground path for electromagnetically shielding cable wires 44 with a conductive braid shield 42. As best shown in FIGS. 2 and 3, in the exemplary embodiment, braid shield 42 includes an end 43 which is turned over a cable jacket 46 and crimped by a ferrule 47. Cable 40 is retained by inner spherical member 36 as described above, with circumferential groove 39 receiving ferrule 47. Ferrule 47 may be made of conductive material such as a phosphorous-bronze metal with tin-nickel plating. Braid shield 42 contacts ferrule 47 which contacts inner spherical member 36 which contacts outer spherical shell 34 which contacts housing 20 which in turn is connected to ground in a traditional manner, thereby providing a continuous electrical path for grounding braid shield 42.

It should be appreciated that the illustrated grounding of braid shield 42 is set forth by way of example, and not by limitation. Other methods of exposing braid shield 42 may be employed. For example, ferrule 47 may be crimped over cable jacket 46 and braid shield 42 wrapped over ferrule 47 and soldered thereto. Moreover, braid shield 42 may directly contact inner spherical member 36, in addition to or instead of ferrule 47,.

The embodiments described above are exemplary. It will, of course, be understood that various modification and additions can be made to the embodiments discussed hereinabove without parting from the scope or spirit of the present invention. For example, the electrical connector may be employed with a number of systems, including computer systems and networks, telecommunications systems, and cable television systems. Accordingly, the scope of the present invention should not be limited to the particular embodiments discussed above, but should be defined only by the full and fair scope of the claims set forth below.

What is claimed is:

1. An electrical connector, comprising:

a housing defining an opening; and a swivel member defining a cable passageway, the swivel member being configured so that an electrical cable can be disposed through the passageway and the opening, wherein the swivel member is pivotally mounted to the housing such that, when the electrical cable is disposed through the passageway and the opening, the cable may pivotally move within the opening;

wherein the swivel member includes an outer member pivotally mounted within the housing and an inner member pivotally mounted within the outer member, the inner member defining the cable passageway, the outer member defining a slot aligned with the cable passageway.

2. An electrical connector as recited in claim 1, wherein the passageway is configured to receive a braided electrical cable having a braid shield and so that, when the braided electrical cable is disposed through the passageway, the braid shield electrically contacts the swivel member and the swivel member electrically contacts the housing for providing a continuous ground path from the shield to the housing for electromagnetic shielding of the cable.

3. An electrical connector as recited in claim 1, wherein the outer member is configured to rotate about a first axis perpendicular to the longitudinal axis of the cable passageway, and the inner member is configured to rotate about a second axis perpendicular to the longitudinal axis of the cable passageway, such that when an electrical cable is disposed in the cable passageway, the electrical cable may pivotally move in any direction with respect to the housing, save about the longitudinal axis of the cable.

4. An electrical connector as recited in claim 3, wherein the outer member comprises an outer spherical shell and the inner member comprises an inner spherical member.

5. An electrical connector as recited to claim 4, wherein the second axis is perpendicular to the first axis.

6. An electrical connector as recited in claim 4, wherein the housing includes a first pair of pivots and the outer spherical shell defines a first pair of holes for receiving the first pivots for pivotally mounting the outer spherical shell about the first axis.

7. An electrical connector as recited in claim 4, wherein the housing defines a first pair of holes and the outer spherical shell includes a first pair of pivots for receiving the first holes for pivotally mounting the outer spherical shell about the first axis.

8. An electrical connector as recited in claim 4, wherein the outer spherical shell includes a second pair of pivots and the inner spherical member defines a second pair of holes for receiving the second pivots for pivotally mounting the inner spherical member about the second axis.

9. An electrical connector as recited in claim 4, wherein the outer spherical shell defines a second pair of holes and the inner spherical member includes a second pair of pivots for receiving the second holes for pivotally mounting the inner spherical member about the second axis.

10. An electrical connector as recited in claim 4, wherein the outer spherical slot comprises a pair of oppositely-faced slots configured to movably receive the cable such that the cable may pivot about the second axis.

11. An electrical connector as recited in claim 4, wherein the inner spherical member comprises two spherical portions, each of the two portions defining part of the passageway, the two spherical portions being capable of being disposed about the electrical cable such that the cable is retained within the passageway, the two spherical members further being capable of attachment together.

12. An electrical connector as recited in claim 11, wherein each of the two spherical portions comprises a hemispherical portion, each hemispherical portion defining half of the passageway.

13. An electrical connector as recited in claim 11, wherein the outer spherical shell comprises two hemispherical shells, the two hemispherical shells being disposed about the inner spherical member and being capable of attachment together.

14. An electrical connector as recited in claim 1, wherein the housing opening includes a chamfered edge, the chamfered edge defining a range of pivotal movement of the electrical cable when the cable is disposed in the passageway.

15. An electrical connector as recited in claim 4, wherein the passageway is configured to receive a braided electrical cable comprising a braid shield having an end fastened by a ferrule, and wherein:

the inner spherical member electrically contacts the outer spherical shell which electrically contacts the housing; and the passageway is configured to receive the braided electrical cable so that the braid shield electrically contacts the inner spherical member thereby providing a continuous ground path from the braid shield to the metal shell for electromagnetically shielding the cable.

16. An electrical connector, comprising:

an exterior housing surrounding a metal shell, the metal shell having a first pair of linearly aligned pivots;

an outer metal spherical shell grounded to the metal shell, the outer spherical shell defining a first pair of holes receiving the first pair of pivots for pivotally mounting the outer spherical shell within the housing, the outer spherical shell having a second pair of pivots; the outer spherical shell defining two oppositely faced slots;

an inner metal sphere grounded to the outer spherical shell, the inner spherical member defining a second pair of holes for receiving the second pair of pivots for pivotally mounting the inner spherical member within the outer spherical shell, the inner spherical member defining a cable passageway configured to receive an electrical cable that includes a braid shield so that the cable may be disposed within the passageway and may pass through the two slots and the opening;

wherein the first and second pivots and associated first and second holes are configured to allow pivoting of the passageway about any axis save its longitudinal axis; and wherein the passageway is configured so that, when the electrical cable is disposed in the passageway, the braid shield is grounded to the inner spherical member, thereby providing a continuous ground path to the metal shell for electromagnetically shielding the cable.

* * * * *